United States Patent [19]

Faessle et al.

[11] Patent Number: 4,541,471

[45] Date of Patent: Sep. 17, 1985

[54] PROCESS FOR THE PRODUCTION OF PRECISION CASTINGS BY THE GYPSUM-MOLD PROCESS

[75] Inventors: Fritz Faessle, Limburgerhof; Siegmund Stadler, Dudenhofen, both of Fed. Rep. of Germany

[73] Assignee: Giulini Chemie GmbH, Fed. Rep. of Germany

[21] Appl. No.: 608,046

[22] Filed: May 7, 1984

[30] Foreign Application Priority Data

May 6, 1983 [DE] Fed. Rep. of Germany ..... 3316571

[51] Int. Cl.[4] ..... B22D 9/00

[52] U.S. Cl. ..... 164/6; 164/7.1

[58] Field of Search ..... 164/6, 7.1, 14, 15, 164/38, 521, 12, 529, 519, 520, 13, 160.1, 253, 255, 119

[56] References Cited

U.S. PATENT DOCUMENTS

| | | | |
|---|---|---|---|
| 2,529,835 | 0/0000 | Dailey | 164/529 |
| 3,651,855 | 3/1972 | Daussau | 164/7.1 |
| 3,741,281 | 6/1973 | Hauser-Lienhard | 164/61 |
| 3,825,058 | 7/1974 | Miura et al. | 164/253 |

FOREIGN PATENT DOCUMENTS

| | | | |
|---|---|---|---|
| 1939433 | 8/1969 | Fed. Rep. of Germany . | |
| 1940924 | 8/1969 | Fed. Rep. of Germany . | |
| 2318850 | 4/1973 | Fed. Rep. of Germany . | |
| 54-4817 | 1/1979 | Japan | 164/521 |

OTHER PUBLICATIONS

Giesserei Lexikon (The Foundry Lexicon), Aug. 1974, pp. 279 to 280.

*Primary Examiner*—Nicholas P. Godici
*Assistant Examiner*—G. M. Reid
*Attorney, Agent, or Firm*—Sughrue, Mion, Zinn, Macpeak, and Seas

[57] ABSTRACT

Process for the production of casting parts with well-defined reproduction of detail and a great accuracy of measurement using the gypsum-form process. The pattern to be copied is equipped with a drainage apparatus, having at least one channel extending outside the molding box, and the molding material is poured into the mold and solidified. After the pattern is removed from the solidified mold by the introduction of compressed gas, the water of the solidified material is removed from, and after drying the mold is connected to a vacuum line and evacuated. The molten mass is then poured into the mold while the vacuum is maintained and solidified.

14 Claims, 1 Drawing Figure

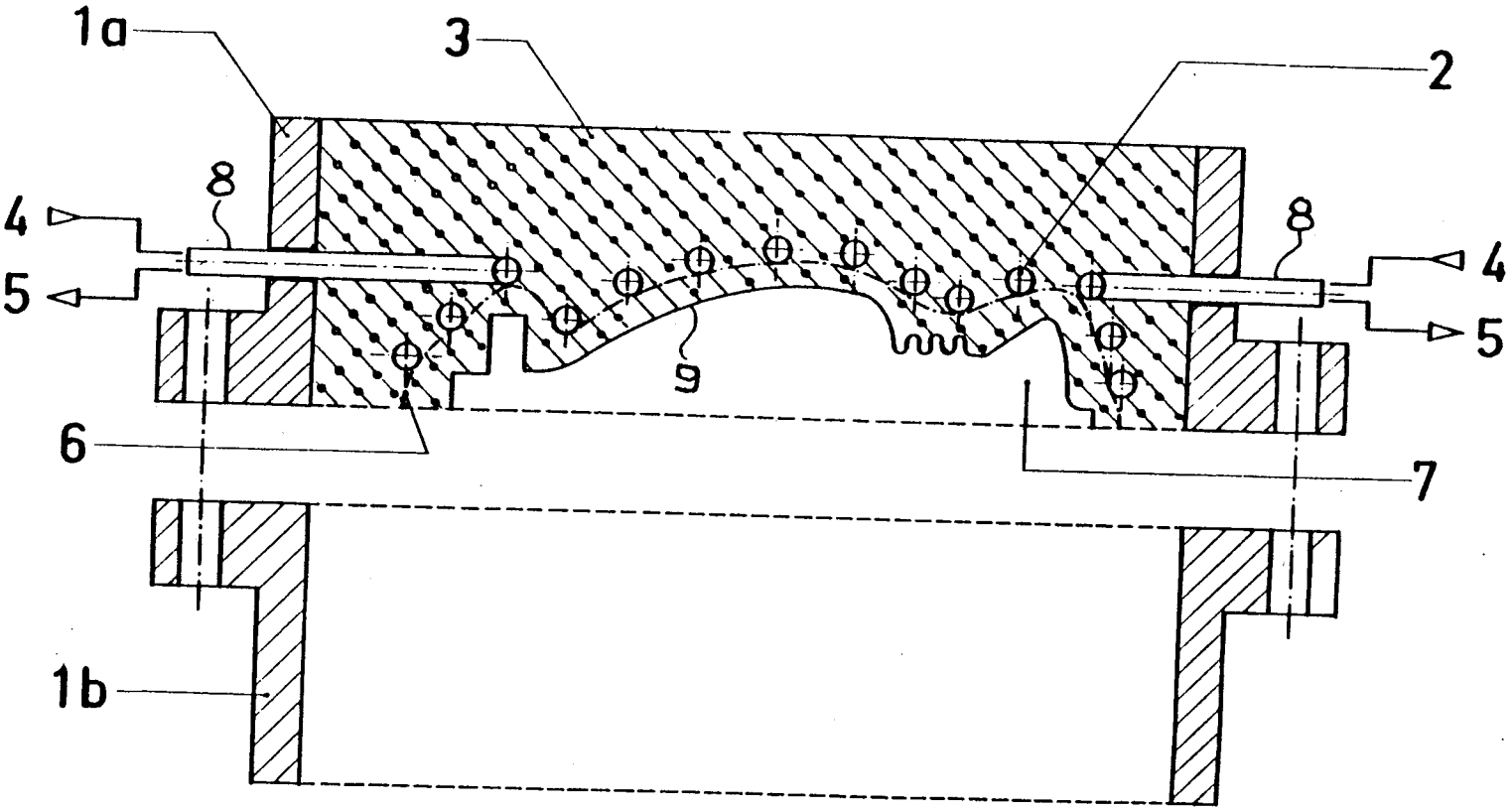
2
4
5
8
7
9
3
1a
8
4
5
6
1b

PROCESS FOR THE PRODUCTION OF PRECISION CASTINGS BY THE GYPSUM-MOLD PROCESS

BACKGROUND OF THE INVENTION

The present invention relates to a process for the production of castings with well-defined reproduction of detail and a high accuracy of dimensional tolerance using the gypsum-mold process, as well as to the precision casting produced with the molding process.

Gypsum-mold processes have been well known for a long time. The mold material in this process consists mainly of gypsum. Further constituents can be, for example, sand, cement, sodium silicate, or asbestos. In such mixtures, gypsum has a function of a bonding agent and is also usable in the higher temperature ranges. Precision castings, however, cannot be produced by this process, nor indeed by the vacuum mold process.

A gypsum-mold process is described in *Giesserei Lexicon* (in translation, *The Foundry Lexicon*), 1974 (pages 279 to 280). The mold sections or pieces made of gypsum produced in this way are dried in the oven at 105°, and are completely unsuitable for the production of metallic precision castings at high temperatures. The gypsum is present in these mold pieces as a dihydrate. With the casting of the molten metal mass, the water escapes so quickly, predominantly in the form of steam, that it causes the mold to split. Gypsum-molds dried at 105° C. are suitable only for castings at room temperature.

U.S. Pat. No. 3,825,058 discloses a process for preparing a mold by a vacuum sealed molding process in which a particulate material, for example, sand, is placed inside a molding box, subjected to a vacuum and compressed to form a mold. The mold has a casting cavity which is defined by a shield member, impermeable to gas, made of synthetic material (plastic) or metal foil. In order to prevent breakdown of the mold during pouring of a molten metal, a tubular member forming a passage serving as a communication means between the mold cavity and the atmosphere is connected to the uppermost portion of the shield member so that the atmospheric pressure can be imparted to the cavity even when the molten metal is being poured into the cavity. In this way, the vacuum in the space between the particles is certain.

Sand-mold processes also have been well known for a long time. Statistics show that the majority of casting series are produced by sand castings. The casting surfaces of the products conditioned by the molding substances employed in the sand cavity necessarily require a high expense for after-treatment, which is quite cost intensive, and today is no longer considered justifiable.

SUMMARY OF THE INVENTION

An object of the present invention is to provide a molding process that shows neither the disadvantages of the sand-mold process nor of the gypsum-mold process.

Additional objects and advantages of the present invention will be set forth in part in the description which follows and in part will be obvious from the description or can be learned by practice of the invention. The objects and advantages are achieved by means of the processes, instrumentalities and combinations particularly pointed out in the appended claims.

To achieve the foregoing objects, and in accordance with its purpose, the present invention provides a process for production of a precision casting, by which a porous foundry mold is produced from a pattern in a molding box out of a castable molding material, containing calcium sulfate hemihydrate as the bonding material, without calcination, comprising: (a) coating the pattern to be copied with a mold release agent and providing the molding box with a drainage having at least one duct which extends outside the molding box; (b) pouring the molding material into the molding box and around a portion of the drainage within the molding box, and solidifying the molding material in the molding box to form a solidified mold having a mold cavity; (c) removing the water from the solidified mold by introducing compressed gas into the drainage, whereby the pattern is removed from the solidified mold, removing the pattern from the molding box, then drying the solidified mold; (d) connecting the dried mold to a vacuum line and evacuating the dried mold; and (e) pouring a molten metal mass into the mold cavity while the vacuum is maintained and solidifying the molten metal.

The process according to the present invention does not require firing of the gypsum molds at temperatures of 400° to 800° C. In this manner, considerable amounts of energy can be saved.

Moreover, a significant characteristic of the process of the present invention is that the water adhering to the molding material is removed through pressurized gas dehydration. In this way, substantial amounts of energy can be saved, so that the casting process is now applicable also to large surface precision casting and series casting. The energy requirement is further lowered through the evacuation during metal casting, with the additional advantage that pressurized gas dehydration and evacuation can be carried out through the same system of drainage apparatus.

In one embodiment of the present invention, a porous hose is used as the drainage, and the porous hose preferably is applied over a close-meshed and moldable wire netting. In another embodiment of the present invention, a perforated fiberglass mat is used as the drainage. Preferably, the drainage for the pattern is mounted with a separation of at least 10 mm from the pattern, especially when a porous hose is employed.

Preferably, the water is removed from the solidified mold material with compressed air, and more preferably the water is forced out by an increasing pressure. It is also preferred to raise the pressure by approximately 0.01 bar per minute until it reaches approximately 1.2 bar.

The drying of the mold preferably is carried out at 60° to 100° C. The molten metal material is preferably poured into the mold under a vacuum of 0.6 bar and is solidified while maintaining the vacuum. Preferably, the mold material comprises or consists essentially of alphacalcium sulfate hemihydrate, chamotte, water, and known auxillary agents.

It is to be understood that both the foregoing general description and the following detailed description are exemplary, but are not restrictive of the invention.

BRIEF DESCRIPTION OF THE DRAWING

The sole figure of the drawing shows a cross-section through a molding box for producing a casting mold in accordance with one embodiment of practicing the process of the present invention.

DETAILED DESCRIPTION OF THE INVENTION

In the practice of the present invention, the original that is to be reproduced, that is, the pattern, is covered with a mold release agent, for example, a thin oil film, and the molding box is furnished with a drainage which can be in the form of a porous hose or a perforated fiberglass mat with holes (apertures) before the mold casting. If the hose method is used, it is desirable to first apply a close-meshed wire netting that is positioned over the original at a distance of about 10 mm from the original and is easily pliable. Finally, the hose is affixed over the wire mesh in a coiled manner, and one end is led outside through the mold box or the chill, respectively, by connecting the hose to a duct which extends into the molding box and forms part of the drainage. If perforated fiberglass mats with holes (apertures) are used, no meshed wire netting is necessary. The fiberglass mats and nettings can be attached to the molding box. They do not contact the pattern. In practicing the present invention, the drainage preferably is distributed over the original in a regular or uniform manner so that all areas of the original can be evenly treated by the drainage.

For the production of the gypsum molds, the molding material is formed from a powder mixture which comprises or consists essentially of alpha calcium sulfate hemihydrate (binding agent), and if necessary, also contains cement, chamotte and/or quartz powder as a filler. The powder mixture is mixed with water to form the molding material.

Enough water is added to the powder mixture to make the mold sufficiently permeable to gas, which is true of a pore volume of at least 25%. In particular, the volume of water should be selected to achieve a desired pore volume of the resulting gypsum mold, (that is, the solidified molding material from which water has been removed by using compressed gas) so that a sufficient gas permeability is obtained when putting into operation the drainage apparatus of the present invention. The pore volume of the resulting mold preferably is at least 25%. The pore volume lies between 25 and 35% if 40 to 45 g water are applied to 100 g powder mixture. Auxiliary materials such as accelerators, inhibitors, fiberglass, etc., can be added to the mixture.

After mixing, the mold material is poured into the prepared molding box to cover the pattern and the drainage on the pattern. Depending on the molding, an upper or lower frame or sectional mold can be produced. The gypsum molding material is then solidified in the molding box.

Immediately after solidifying of the molding material, the solidified molding material is connected to a compressed air conductor for the removal of water by attaching the compressed air conductor to the drainage in the solidified material via the duct, whereby the original is removed from the mold and from the molding box.

The removal of the water is preferably carried out with an increase in pressure of 0.01 bar per minute, and indeed, the pressure is continuously increased, for example, from a starting pressure of about 0.2 bar, until approximately 1.2 bar is reached. For complete water removal, this final pressure is maintained for some time, about 10 to 20 minutes.

In most cases, 10 to 20 minutes at the final pressure is sufficient to completely remove the water. The pore volume formed by removing the water with the compressed gas is of particular importance for subsequent metal castings.

After the water is removed, the solidified mold is dried, as by subjecting it to a temperature of 60° to 80° C. overnight. The drying of the mold can be carried out at 60° to 100° C. in 24 hours, if the molds are very big.

After drying, and before the metal is cast, a vacuum line is connected to the solidified gypsum mold via the drainage. This can be carried out either with a direct working vacuum pump of sufficient capacity, or also with a pre-evacuated container. Directly before the metal casting, the negative molding is evacuated and the molten metal mass is poured directly in. The evacuation is continued until the molten metal mass solidifies.

The maximum gas amount which must be eliminated during the evacuation is 400 l/sq. m molding surface. For reduction of vacuum loss, it is essential for the process according to the present invention that the thickness of the back wall of the mold is greater than the distance between the hose and the work surface of the pattern. In most cases, a double or triple wall thickness suffices.

With careful processing, and above all, regular distribution of the drainage, very smooth metal surfaces will be formed, which are technically advantageous.

Referring now to the drawing, there is shown a cross-section (side view) through a molding box for producing a gypsum casting mold in accordance with one embodiment of the process according to the present invention. As shown in the drawing, a molding box is comprised of a first section 1*a* in the form of an upper box-half and a second section 1*b* in the form of a lower box-half.

A pattern 7 lies in box-half 1*a* and is surrounded with a wire net 6, on which a porous hose 2 is arranged in a coiled manner. Ducts or channels 8 extend into section 1*a* and are connected to porous hose 2. Pressurized gas is introduced through ducts 8, as represented by air gas line 4, and the vacuum is applied through the same channels, as represented by vacuum line 5. The molding material is designated with the reference number 3. Pattern 7 has a work surface 9.

The present invention is to be contrasted with the vacuum-sealed molding process of U.S. Pat. No. 3,825,058, and provides a new process in which there is a casting of a molten mass while vacuum is maintained on the contacting surfaces of mold to metal in the evacuated mold. In the present invention, neither a protective layer of synthetic material or a metal layer, nor a vacuum is required to form a casting mold. Moreover, the gypsum mold does not decompose into particulate material by termination of the vacuum, with the so decomposed particulate material then being used for the production of another mold by means of a vacuum. The gypsum mold of the present invention is not produced by a vacuum-sealed molding process. Moreover, in the present invention, the gypsum mold is held under a vacuum during the casting of the metal and the solidifying. Further, an air passage to contact the mold with the atmosphere is unnecessary. In the present invention, the vacuum is required during the casting of the metal in the mold, not for the maintenance of the mold between the particles of the fine-particled matter. Moreover, in the present invention the porous gas conducting elements are positioned for the introduction of compressed gases in order to remove water.

The following examples are given by way of illustration to further explain the principles of the invention. These examples are merely illustrative and are not to be understood as limiting the scope and underlying principles of the invention in any way. All percentages referred to herein are by weight unless otherwise indicated.

EXAMPLE 1

For the production of a negative mold, a synthetic material (pattern), approximately 20×10×8 cm, was coated with an extremely thin oil film as the mold release agent, and placed in a molding box with inside measurements of 24×14×11 cm. On the surface of this original, a malleable wire netting of approximately 2 to 3 cm mesh was fitted. After this fitting, a porous woven hose of 8 mm diameter was wound on with a lateral separation of about 2 cm, and the hose end was attached to a duct or socket mounted on the molding box. This drainage apparatus was fixed approximately 1 cm from the pattern.

The thus prepared molding box was filled with a molding material prepared from 5 kg of a powder mixture, comprising:

40.0% alpha-calcium sulfate hemihydrate
59.0% chamotte (<1 mm)
0.5% white lime
0.3% fiberglass, 3 to 5 mm fiber length
0.2% potassium sulfate which was mixed homogeneously for one minute with 2 liters of water. The molding material was poured into the molding box in a thin stream, beginning in the middle to avoid formation of trapped bubbles.

One minute after the solidification is complete (determined by pressing with a finger) compressed air was connected to the drainage via the duct. The beginning pressure was 0.2 bar, and the pressure was increased by 0.01 bar per minute. After 100 minutes, the pressure was 1.2 bar, which was maintained until no more water was evacuated.

By application of pressure, the original was separated from the molding material. The molding box with the negative pattern was smoothly lifted up and set on end, so that the water which had been removed could run off freely. The remaining drying of the molding box with the negative model took place overnight at 60° to 80° C.

After drying, the molding box with the negative pattern was connected via the drainage to a vacuum hose for subsequent aluminum casting. A negative pressure of −0.9 bar was applied. The molten aluminum (720° C.) was poured in the evacuated mold. Demolding of the casting followed after complete solidification of the alloy, which was the case after 20 minutes. The negative mold could be used for three further castings.

EXAMPLE 2

Instead of the porous hose applied in Example 1, a perforated mineral wool fiber mat 2 mm thick was used. The diameter of the perforations was 1.5 cm, and the distance from perforation to perforation was 2 to 3 cm. In order to prevent the mineral wool mat from floating up, it was dipped briefly in water. Before fixing the drainage in place, the molding box was filled with the molding material to a thickness of about 1 cm over the original, and then the mineral wool fiber mat was affixed at a distance of approximately 1 cm over the surface of the original, after which the molding box was filled up. Release, evacuation and metal casting followed as in Example 1.

It will be understood that the above description of the present invention is susceptible to various modifications, changes and adaptations, and the same are intended to be comprehended within the meaning and range of equivalents of the appended claims.

What is claimed is:

1. A process for production of a precision casting, by which a porous foundry mold is produced from a pattern in a molding box out of a castable molding material, containing calcium sulfate hemihydrate as the bonding material, without calcination, comprising (a) coating the pattern to be copied with a mold release agent and providing the molding box pattern with a drainage having at least one duct which extends outside the molding box;

(b) pouring the molding material into the molding box and around a portion of the drainage which is within the molding box, and solidifying the molding material in the molding box to form a solidified mold having a mold cavity;

(c) removing the water from the solidified mold by introducing compressed gas into the drainage, whereby the pattern is removed from the solidified mold, removing the pattern from the molding box, then drying the solidified mold;

(d) connecting the dried mold to a vacuum line and evacuating the dried mold; and (e) pouring the molten metal mass into the mold cavity while the vacuum is maintained and solidifying the molten metal.

2. The process according to claim 1, wherein a porous hose is used as said drainage.

3. The process according to claim 1, wherein the porous hose is applied over a close-meshed and moldable wire netting.

4. The process according to claim 1, wherein perforated fiberglass mat is used as said drainage.

5. The process according to claim 1, wherein the drainage in the molding box pattern is mounted with a separation of at least 10 mm from the pattern.

6. The process according to claim 1, wherein the water is removed from the solidified mold material with compressed air.

7. The process according to claim 6, wherein the water is forced out by an increasing pressure.

8. The process according to claim 7, wherein the pressure is raised by approximately 0.01 bar per minute until it reaches approximately 1.2 bar.

9. The process according to claim 1, wherein the drying of the mold is carried out at 60° to 100° C.

10. The process according to claim 1, wherein the molten metal material is poured into the mold cavity under a vacuum of 0.6 bar and is solidified while maintaining the vacuum.

11. The process according to claim 1, wherein the mold material which is poured into the molding box comprises alpha-calcium sulfate hemihydrate, chamotte, and water.

12. The process according to claim 1, wherein the vacuum is maintained during solidifying of the molten metal.

13. The process according to claim 12, wherein the mold is connected with the vacuum line via the drainage.

14. The process according to claim 1, wherein the mold is connected with the vacuum line via the drainage.

* * * * *